US005875254A

United States Patent [19]

Hanright

[11] Patent Number: 5,875,254

[45] Date of Patent: Feb. 23, 1999

[54] BINAURAL HEARING AID WITH INTEGRATED RETRIEVAL LINE AND MICROPHONE

[75] Inventor: William L. Hanright, Greenpond, N.J.

[73] Assignee: Siemens Hearing Instruments, Inc., Piscataway, N.J.

[21] Appl. No.: 993,540

[22] Filed: Dec. 18, 1997

[51] Int. Cl.[6] ..... H04R 25/00

[52] U.S. Cl. ..... 381/329; 381/324; 381/328

[58] Field of Search ..... 381/318, 322, 381/324, 328, 329, 309, 327, 330

[56] References Cited

U.S. PATENT DOCUMENTS

| | | | |
|---|---|---|---|
| 4,291,203 | 9/1981 | Bellafiore | 381/328 |
| 5,033,090 | 7/1991 | Weinrich | 381/318 |
| 5,201,006 | 4/1993 | Weinrich | 381/328 |

*Primary Examiner*—Huyen Le
*Attorney, Agent, or Firm*—Mark H. Jay

[57] ABSTRACT

One microphone of a binaural Completely-In-Canal ("CIC") hearing aid is located at the distal end of the retrieval line. This reduces coupling between the microphones and receiver. Additionally, by locating the microphone at the distal end of the retrieval line, the faceplate need not be enlarged.

4 Claims, 2 Drawing Sheets

BINAURAL HEARING AID WITH INTEGRATED RETRIEVAL LINE AND MICROPHONE

BACKGROUND OF THE INVENTION

The invention relates to binaural hearing aids, and more specifically relates to small binaural hearing aids. In its most immediate sense, the invention relates to binaural CIC and ITE aids, i.e. hearing aids which are worn Completely In the Canal of the patient's ear or In The Ear of the patient.

Conventional hearing aids have only one microphone, and that microphone is generally of a nondirectional type (so the patient can hear sound from any direction relative to the patient's head). This nondirectionality impairs the patient's ability to determine the direction from which a sound originates. This can cause difficulties for the patient. For example, when a patient is addressed by another person and seeks to face the speaker, the patient may turn in the wrong direction. Similarly, if a patient hears a directive to e.g. move out of the way of danger, the patient may move in the wrong direction and toward the danger. For these reasons, binaural hearing aids have been developed.

A binaural hearing aid is an aid having two or more microphones. When a sound is detected by more than one microphone, the outputs of the microphones will almost always be different because the microphones will only seldom be precisely equidistant from the sound source. As a result, the directionality of the sound produces changes in the electrical signals from the microphones. By appropriate design of the hearing aid circuit, these changes can be used to vary the audio output from the hearing aid, thereby making it possible for the patient to assess, at least approximately, the direction from which a sound originates.

As a practical matter, a binaural hearing aid cannot provide useful information unless the microphones are sufficiently spaced apart. At a minimum, the microphones must be 12 mm apart. Such a spacing is very difficult to achieve with a CIC aid and with certain ITE aids.

A CIC aid is very tiny because it is worn deep within the patient's ear so as to be inconspicuous and indeed almost invisible. The small size of a CIC aid makes it difficult to provide a CIC aid with binaural capability.

This difficulty comes about because a conventional single-microphone CIC aid has the microphone ported through the faceplate. If a conventional CIC aid design is modified to provide two microphones ported through the faceplate, the faceplate must be enlarged. Such an enlargement makes the aid less marketable, because fewer patients have ear canals that are sufficiently large to accommodate the aid. Furthermore, adding an additional microphone to the faceplate of a conventional CIC design increases the risk of feedback. This is because faceplate space is limited, and when an additional microphone is added to the faceplate, one or both of the microphones may be well coupled to the receiver. An ITE aid, while being larger than a CIC aid, is also relatively small and is subject to the same problems (although the problems are somewhat less severe).

It would be advantageous to provide a binaural hearing aid having the cosmetic advantages of a CIC aid or a small ITE aid without being unduly large. And it would also be advantageous to provide a binaural CIC or ITE hearing aid that would not be unduly subject to feedback.

The invention proceeds from the realization that the retrieval line that is always provided on a CIC aid can support an additional microphone to thereby produce a binaural hearing aid. A retrieval line is a thin filament of e.g. skin-colored plastic that is fixed to the hearing aid housing and that is sufficiently long to extend out of the patients ear canal. A retrieval line may be, and conventionally is, enlarged at its distal end to make it more easily graspable.

In accordance with the invention, a binaural hearing aid is provided. The aid has a housing; the housing has a faceplate and contains a hearing aid circuit. An elongated flexible line is provided. The line has a proximal end fixed to said housing and a distal end remote from said housing, and the line extends from the housing in such a manner that a patient wearing the hearing aid in an ear can grasp the line and can pull the hearing aid out of the ear by pulling on the line.

A first microphone is located within the housing. The first microphone is operatively connected to the hearing aid circuit and is ported through the faceplate. A second microphone is also provided. The second microphone is operatively connected to the hearing aid circuit and is fixed to the distal end of the line.

Because the second microphone is located at the distal end of the line, it occupies no additional space on the faceplate. Consequently, the overall size of the faceplate (and therefore of the aid) need not be increased. Furthermore, the coupling between the microphones and the receiver is substantially less than it would be if both microphones were ported through the faceplate. This reduction in coupling makes the aid less subject to feedback.

When the distal end of the line is enlarged, this makes it easier for arthritic and nondexterous patients to grasp the end of the cable.

BRIEF DESCRIPTION OF THE DRAWINGS

The invention will be better understood with reference to the following illustrative and non-limiting drawings, in which.

DETAILED DESCRIPTION OF A PREFERRED EMBODIMENT

Figure 1A:
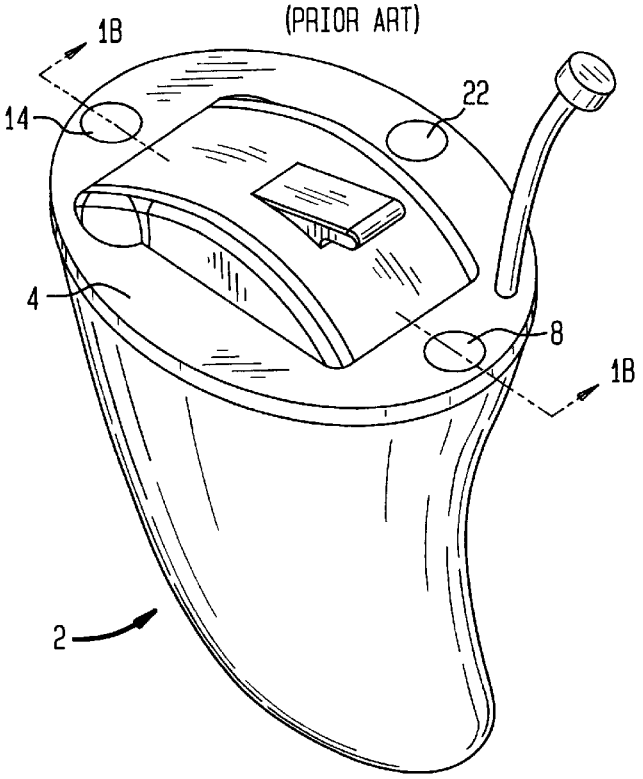
FIG. 1A (PRIOR ART)
FIGS. 1A and 1B illustrate a binaural CIC hearing aid in which a conventional design is modified to add an additional microphone on the faceplate.
Figure 1B:
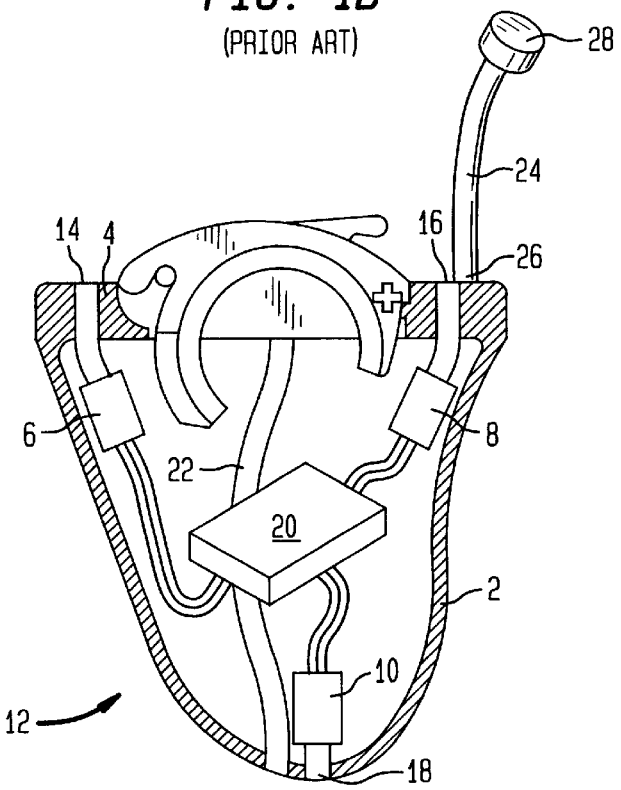
FIG. 1B (PRIOR ART)

FIGS. 1A and 1B show a rigid plastic CIC housing generally indicated by reference number 2. The housing 2 has a faceplate 4. The faceplate 4 faces towards the outside when the hearing aid is placed in the patient's ear (not shown). The faceplate 4 supports two microphones 6 and 8, and a receiver 10 is located at the tip 12 of the housing 2. The faceplate 4 is ported at 14 and 16 so sound can enter the microphones 6 and 8, and the housing 2 is ported at 18 so sound from the receiver 10 can enter the patient's ear. The microphones 6 and 8 and the receiver 10 are operatively connected to a hearing aid circuit 20. To reduce discomfort caused by the occlusion effect (a feeling that the ear is occluded or plugged-up) a vent tube 22 extends between the faceplate 4 and the tip 12 of the housing 2 to vent the patient's ear canal to the outside. The proximal end 26 of a retrieval line 24 is attached to the faceplate 4, and the distal end 28 of the line 24 is enlarged. The line 22 is a flexible filament of skin-colored monofilament nylon; such lines are known in the art.

This arrangement would be disadvantageous. For this arrangement to perform adequately as a binaural hearing aid, the distance between the microphones 6 and 8 should be at least 12 mm. To permist such a spacing, the faceplate 4 would need to measure at least 16 mm along its longest dimension. Such a large faceplate 4 would be too big for many patients.

Additionally, this arrangement would also be prone to feedback. This feedback would result from two sources. The first source is mechanical coupling between the microphones 6 and 8 and the receiver 10. In this arrangement, vibration of the receiver 10 would be transmitted to the housing 2, which would transmit it to the faceplate 4, which would in turn transmit it to the microphones 6 and 8. This coupling would create positive feedback loops, since vibration of the microphones 6 and 8 would increase the electrical output of the microphones 6 and 8.

The second source of feedback would be acoustical coupling between the microphones 6 and 8 and the receiver 10. This acoustical coupling would exist because sound from the receiver 10 would be transmitted through the vent tube 22 to the faceplate 4, from which it would propagate to the microphones 6 and 8. This propagation could be expected to create substantial feedback, because each of the microphones 6 and 8 would be quite close to the open faceplate end of the vent tube 22 and increased sound input to the microphones 6 and 8 would increase their electrical outputs.

Figure 2A:
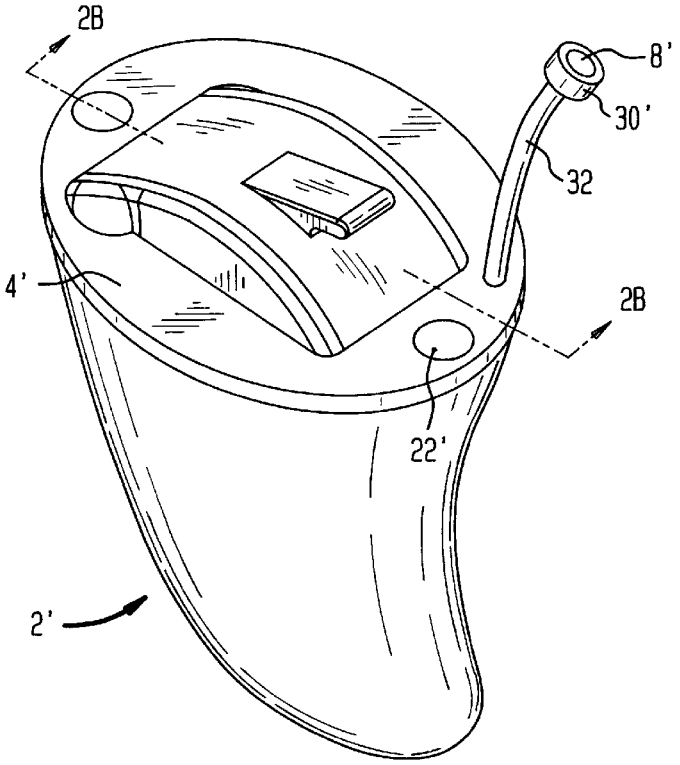
FIGS. 2A and 2B illustrates a preferred embodiment of the invention.
Figure 2B:
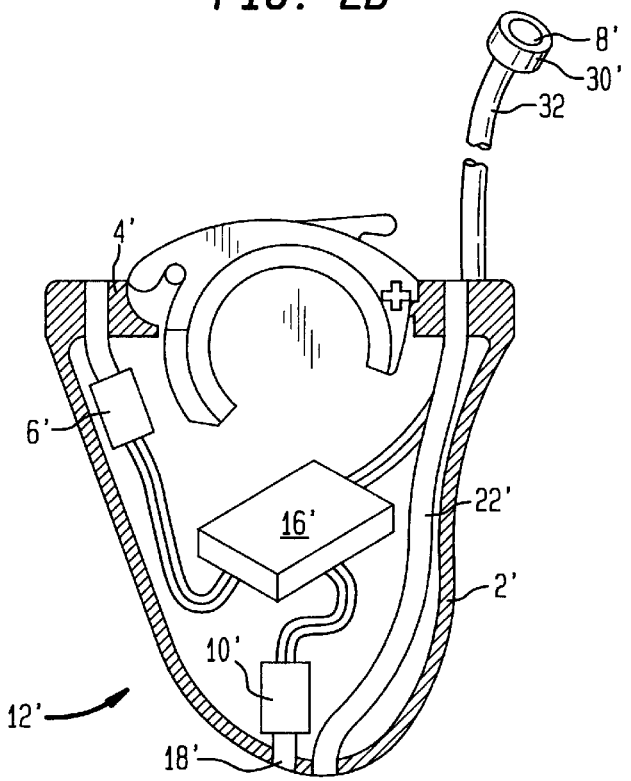

In accordance with a preferred embodiment of the invention as is illustrated in FIGS. 2A and 2B, a CIC housing generally indicated by reference number 2' has a faceplate 4'. The preferred embodiment has microphones 6' and 8' and a receiver 10'. The receiver 10' is located at the tip 12' of the housing 2' and ported to the interior of the patient's ear at 18' as in the conventional aid described above, but the microphone 8' is at a different location (described below).

The microphones 6' and 8' and the receiver 10' are operatively connected to a hearing aid circuit 16'. As in the conventional aid discussed above, a vent tube 22' extends between the tip 12' and the faceplate 4', and vents the patient's ear to reduce the occlusion effect.

In accordance with the preferred embodiment of the invention, the microphone 8' is located entirely outside the housing 2'. In accordance with the preferred embodiment of the invention, the microphone 8' is located at the distal end 30' of a retrieval line 32, which is attached to the faceplate 4'. Advantageously, the distal end 30' is enlarged to form a head, which makes it easier for a patient to grasp the distal end and to thereby remove the aid from the ear. The retrieval line 32 is generally similar to the retrieval line 22; both are flexible and both are made of the same material or of similar materials. However, the retrieval line 32 may be slightly thicker to accommodate the wires that connect the microphone 8' to the circuit 16'. The enlarged distal end 30' may be formed by the body of the microphone 8' or the microphone 8' may be embedded in the distal end 30'. Regardless how the enlargement of the distal end 30' is accomplished, the enlargement makes it easier for the patient to grasp the line 32.

The preferred embodiment of the invention is smaller than the above-described conventional aid design because a 12 mm distance between the microphones 6' and 8' does not require a 16 mm length of the faceplate 4. And, the preferred embodiment of the invention is less prone to feedback than is the conventional aid design discussed above. Mechanical coupling between the microphone 8' and the receiver 10' is reduced because the flexible line 32 damps vibration and reduces vibration amplitude before the vibration reaches the microphone 8'. Acoustic coupling between the microphones 6' and 8' and the receiver 10' is reduced because in accordance with the preferred embodiment of the invention, the distance between each of the microphones 6' and 8' and the faceplate end of the vent tube 22' is greater than the distance between each of the microphones 6 and 8 and the faceplate end of the vent tube 22'.

It will be understood that the housings 2 and 2' are custom-molded to fit the patient's ear canal and that the illustrations are only exemplary. Parts of the Figures have been selectively enlarged and simplified for clarity, and the Figures are not to scale. Furthermore, it will also be understood that although the invention is particularly useful when used in a CIC hearing aid application, this is merely preferred and not necessary. The invention can also be implemented in an In The Ear ("ITE") aid, or in any aid which is to be provided with a retrieval line for the convenience of the patient.

Although a preferred embodiment has been described above, the scope of the invention is limited only by the following claims:

I claim:

1. A binaural hearing aid, comprising:

an in-the-ear housing having a faceplate and containing a hearing aid circuit;

an elongated flexible line, the line having a proximal end fixed to said housing and a distal end remote from said housing, the line extending from the housing in such a manner that a patient wearing the hearing aid in an ear can grasp the line and can pull the hearing aid out of the ear by pulling on the line;

a first microphone located within the housing, operatively connected to the hearing aid circuit, and ported through the faceplate; and a second microphone operatively connected to the hearing aid circuit and fixed to the distal end of the line.

2. The hearing aid of claim 1, wherein the distal end of the line is enlarged.

3. A completely-in-canal ("CIC") hearing aid, comprising:

a CIC housing having a faceplate and containing a hearing aid circuit;

an elongated flexible line, the line having a proximal end fixed to said housing and a distal end remote from said housing, the line extending from the housing in such a manner that a patient wearing the hearing aid in an ear can grasp the line and can pull the hearing aid out of the ear by pulling on the line;

a first microphone located within the housing, operatively connected to the hearing aid circuit, and ported through the faceplate; and a second microphone operatively connected to the hearing aid circuit and fixed to the distal end of the line.

4. The hearing aid of claim 3, wherein the distal end of the line is enlarged.

* * * * *